US009226056B2

(12) United States Patent
Pan

(10) Patent No.: US 9,226,056 B2
(45) Date of Patent: Dec. 29, 2015

(54) SPEAKER MODULE AND THIN ELECTRONIC DEVICE HAVING THE SAME

(71) Applicant: Wistron Corporation, New Taipei (TW)

(72) Inventor: Li-Ping Pan, New Taipei (TW)

(73) Assignee: Wistron Corporation, New Taipei (TW)

( * ) Notice: Subject to any disclaimer, the term of this patent is extended or adjusted under 35 U.S.C. 154(b) by 38 days.

(21) Appl. No.: 14/247,259

(22) Filed: Apr. 8, 2014

(65) Prior Publication Data

US 2015/0195636 A1 Jul. 9, 2015

(30) Foreign Application Priority Data

Jan. 6, 2014 (TW) ..... 103100402 A

(51) Int. Cl.
*H04R 1/02* (2006.01)

(52) U.S. Cl.
CPC . *H04R 1/025* (2013.01); *H04R 1/02* (2013.01)

(58) Field of Classification Search
CPC ..... H04R 1/02
USPC ..... 181/199
See application file for complete search history.

(56) References Cited

U.S. PATENT DOCUMENTS

| | | | | |
|---|---|---|---|---|
| 5,092,424 | A * | 3/1992 | Schreiber et al. | 181/145 |
| 5,740,259 | A * | 4/1998 | Dunn | 381/332 |
| 5,821,471 | A * | 10/1998 | McCuller | 181/156 |
| 6,141,428 | A * | 10/2000 | Narus | 381/338 |
| 7,565,948 | B2 * | 7/2009 | Parker et al. | 181/148 |
| 7,584,820 | B2 * | 9/2009 | Parker et al. | 181/155 |
| 8,675,903 | B2 * | 3/2014 | Ng et al. | 381/345 |
| 8,837,763 | B1 * | 9/2014 | Millen et al. | 381/345 |
| 2003/0213642 | A1 * | 11/2003 | Powell | 181/199 |
| 2006/0291684 | A1 * | 12/2006 | Chick et al. | 381/349 |
| 2007/0127760 | A1 * | 6/2007 | Saiki et al. | 381/351 |
| 2010/0220866 | A1 | 9/2010 | Hsu | |

* cited by examiner

*Primary Examiner* — Forrest M Phillips
(74) *Attorney, Agent, or Firm* — Jianq Chyun IP Office

(57) ABSTRACT

A speaker module of the invention includes a housing, two passive radiators and a speaker. The housing has two side walls. The two passive radiators are respectively disposed at the two side walls, wherein the two passive radiators are overlapped with each other in a direction and have a gap therebetween. The speaker is disposed at the housing, wherein an acoustic wave emitted from the speaker drives the two passive radiators to vibrate in the direction. In addition, a thin electronic device with the speaker module is also provided.

13 Claims, 4 Drawing Sheets

SPEAKER MODULE AND THIN ELECTRONIC DEVICE HAVING THE SAME

CROSS-REFERENCE TO RELATED APPLICATION

This application claims the priority benefit of Taiwan application serial no. 103100402, filed on Jan. 6, 2014. The entirety of the above-mentioned patent application is hereby incorporated by reference herein and made a part of this specification.

BACKGROUND OF THE INVENTION

1. Field of the Invention

The invention generally relates to a speaker module and an electronic device, and more particularly, to a speaker module containing passive radiators and a thin electronic device with the speaker module.

2. Description of Related Art

Along with the increasingly developments of the semiconductor industry and the relevant electronics industries, notebook, tablet PC, all-in-one computer (AIO computer), flat-screen TV and other electronic devices are all developing toward a more convenient, versatile and artistic direction.

The aforementioned electronic devices must be respectively equipped with a speaker for outputting sound, which is generally a slim speaker disposed in the electronic device to comply with the slimming design-trend. However, for an electronic device following after the sliming design criteria, it is unable to maintain a high structural strength and the parts thereof are disposed more close to each member, at the case, if to enhance subwoofer performance of the speaker thereof, the low-frequency vibration of the speaker tends to make the parts of the electronic device collide each other to produce unexpected noise and affect the sound output quality of the electronic devices. Accordingly, how to avoid a thin speaker from producing excessive vibration while maintain an advanced subwoofer performance has become an important issue for the design.

SUMMARY OF THE INVENTION

Accordingly, the invention is directed to a speaker module with good subwoofer performance and smaller vibration level.

The invention is also directed to a thin electronic device, wherein the speaker module has good subwoofer performance and smaller vibration level.

A speaker module of the invention includes a housing, two passive radiators and a speaker. The housing has two side walls. The two passive radiators are respectively disposed at the two side walls, wherein the two passive radiators are overlapped with each other in a direction and have a gap therebetween. The speaker is disposed at the housing, and an acoustic wave emitted from the speaker drives the two passive radiators to vibrate in the direction.

In an embodiment of the invention, each of the above-mentioned passive radiators includes a mass block and an elastic element. The elastic element is connected between the mass block and the housing, and the mass block is configured to vibrate in the direction through elastic deformation of the elastic element.

In an embodiment of the invention, the masses of the above-mentioned two mass blocks are the same as each other.

In an embodiment of the invention, the elastic coefficients of the above-mentioned two elastic elements are the same as each other.

In an embodiment of the invention, each of the above-mentioned passive radiators is connected to the corresponding side wall in fastening way.

In an embodiment of the invention, the above-mentioned housing includes a first chamber, a second chamber and a tube, the tube is connected between the first chamber and the second chamber, the speaker is disposed at the first chamber, the two passive radiators are disposed at the second chamber, and the acoustic wave emitted from the speaker is configured to reach the second chamber via the tube.

A thin electronic device of the invention includes a body and at least one speaker module. The body has a case. The speaker module includes a housing, two passive radiators and a speaker. The housing is disposed in the case and has two opposite side walls. The two passive radiators are respectively disposed at the two side walls, wherein the two passive radiators are overlapped with each other in a direction and have a gap therebetween. The speaker is disposed at the housing, wherein an acoustic wave emitted from the speaker drives the two passive radiators to vibrate in the direction.

In an embodiment of the invention, the quantity of the above-mentioned at least one speaker module is two. The case has a bottom side, and the two speaker modules are respectively disposed at opposite two ends of the bottom side.

In an embodiment of the invention, the above-mentioned thin electronic device has a display surface, wherein the thickness of the housing in the direction perpendicular to the display surface is less than thicknesses of the housing in other directions.

In an embodiment of the invention, the above-mentioned gap between the two passive radiators ranges ⅕-⅐ of the outer diameter of each the passive radiator.

In an embodiment of the invention, the projections of the above-mentioned two passive radiators at each of the side walls coincide with each other.

In an embodiment of the invention, the above-mentioned housing includes a first chamber, a second chamber and a tube, the first chamber is disposed at a first area in the case, the second chamber is disposed at a second area in the case, the tube is connected between the first chamber and the second chamber, the speaker is disposed at the first chamber, the two passive radiators are disposed at the second chamber, and the acoustic wave emitted from the speaker is configured to reach the second chamber via the tube.

Based on the depiction above, the speaker module of the invention is able to enhance the subwoofer performance thereof by employing the two passive radiators, wherein the two passive radiators are respectively disposed in symmetrical manner at the two side walls of the housing and are overlapped with each other. Thus, when the acoustic wave emitted from the speaker drives the two passive radiators, the low-frequency vibrations produced by the two passive radiators can counteract each other. In this way, the speaker module can have good subwoofer performance and smaller vibration level so as to advance the sound output quality of the thin electronic device.

In order to make the features and advantages of the present invention more comprehensible, the present invention is further described in detail in the following with reference to the embodiments and the accompanying drawings.

DESCRIPTION OF THE EMBODIMENTS

Figure 1:
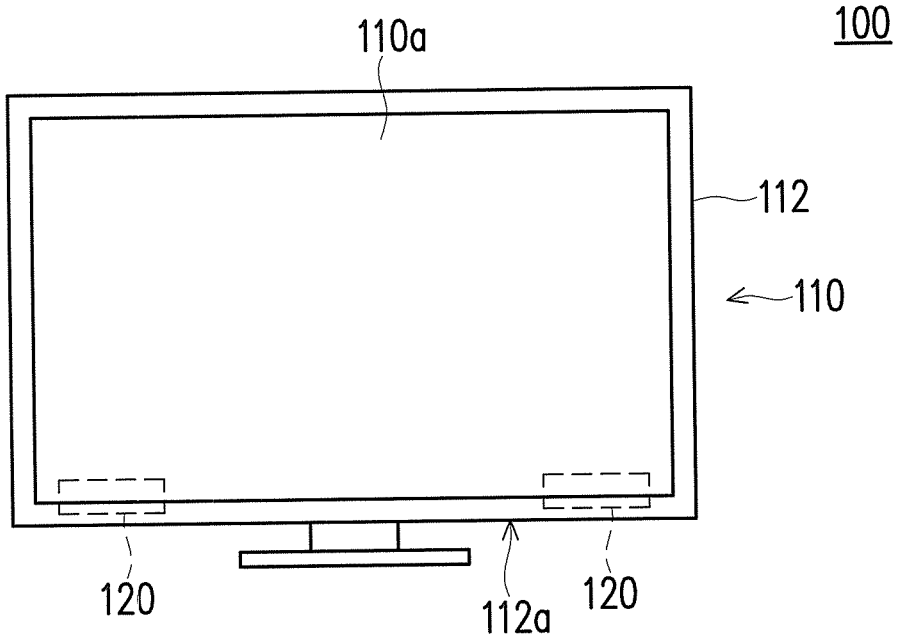
FIG. 1 is a schematic diagram of a thin electronic device according to an embodiment of the invention.

FIG. 1 is a schematic diagram of a thin electronic device according to an embodiment of the invention. Referring to FIG. 1, a thin electronic device 100 of the embodiment is, for example, a flat-screen TV and includes a body 110 and at least one speaker module 120 (in the figure, two models are shown). The body 110 has a case 112 having a bottom side 112*a*. The two speaker modules 120 are respectively disposed at the opposite two ends of the bottom side 112*a* to provide sound output function. In other embodiments, the thin electronic device 100 is, for example, a display screen of a desktop computer or an all-in-one PC (AIO PC), which the invention is not limited to.

Figure 2:
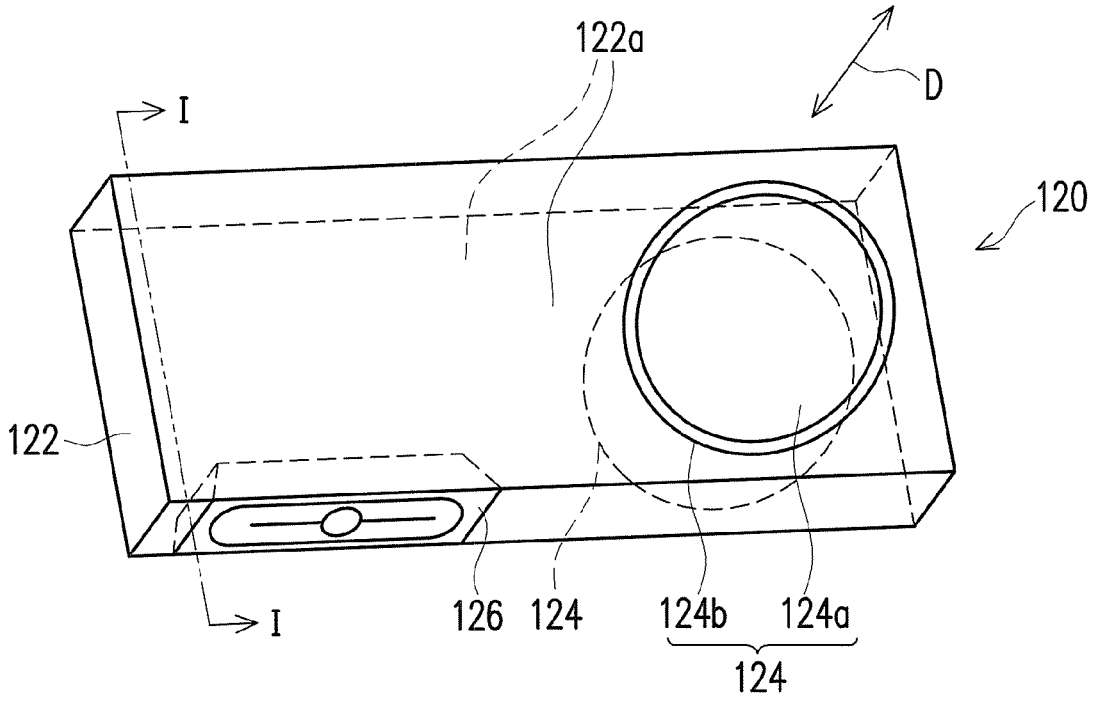
FIG. 2 is a diagram of the speaker module of FIG. 1.
Figure 3:
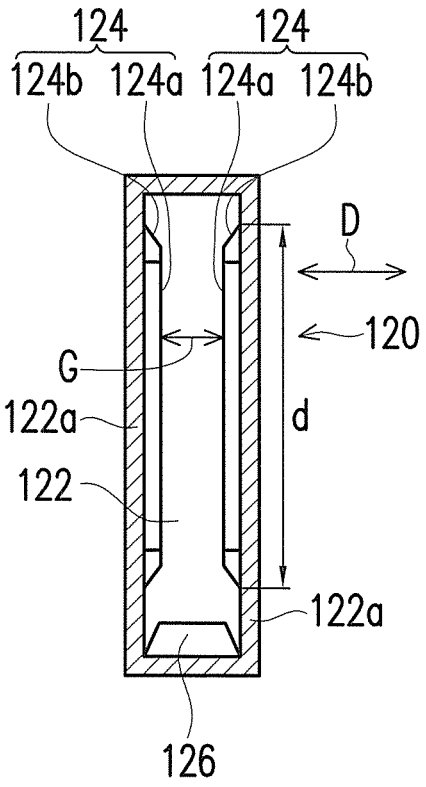
FIG. 3 is a cross-sectional diagram along line I-I of the speaker module of FIG. 2.

FIG. 2 is a diagram of the speaker module of FIG. 1 and FIG. 3 is a cross-sectional diagram along line I-I of the speaker module of FIG. 2. Referring to FIGS. 2 and 3, in more details, the speaker module 120 of the embodiment includes a housing 122, two passive radiators 124 and a speaker 126. The housing 122 is disposed in the case 112 of the thin electronic device 100 (shown in FIG. 1) and has two side walls 122*a*. The two passive radiators 124 are respectively disposed at the two side walls 122*a*. The two passive radiators 124 are overlapped with each other in a direction D and have a gap G therebetween. The speaker 126 is disposed at the housing 122, and the acoustic wave emitted from the speaker 126 drives the two passive radiators 124 to vibrate in the direction D so as to enhance the subwoofer sound of the speaker module 120 through the low-frequency vibration produced by the two passive radiators 124. In the embodiment, each of the passive radiators 124 is connected to the corresponding side wall 122*a* by using, for example, fastening way. In other embodiments, each of the passive radiators 124 can be assembled by using other appropriate ways, which the invention is not limited to.

Under the aforementioned layout, since the two passive radiators 124 are respectively disposed in symmetrical manner at the two side walls 122*a* of the housing 122 and overlapped with each other, thus, when the acoustic wave emitted from the speaker 126 drives the two passive radiators 124, the two low-frequency vibrations produced by the two passive radiators 124 would counteract each other. Therefore, the speaker module 120 can have good subwoofer performance and a smaller vibration level so as to advance the sound output quality of the thin electronic device 100. Moreover, since the speaker module 120 has a smaller vibration level as described above, the thin electronic device 100 has no need to additionally employ damping sub-assemblies so as to save the fabrication cost of the thin electronic device 100.

Each of the passive radiators 124 in the embodiment includes a mass block 124*a* and an elastic element 124*b*. The elastic element 124*b* is connected between the mass block 124*a* and the housing 122. When the acoustic wave emitted from the speaker 126 drives the two passive radiators 124, the mass block 124*a* can vibrate in the direction D through the elastic deformation of the elastic element 124*b*. The elastic element 124*b* is, for example, a rubber diaphragm or other suitable elastic members, which the invention is not limited to. In the embodiment, in more details, the masses of the two mass blocks 124*a* are, for example, the same as each other, the elastic coefficients of the two elastic elements 124*b* are the same as each other, and the projections of the two passive radiators 124 at each of the side walls 122*a*, for example, coincide with each other to enable the two passive radiators 124 disposed in completely symmetrical manner so as to ensure the two vibrations produced by the two passive radiators 124 counteracting each other.

It should be noted that, if the distance between the two passive radiators 124 is too far from each other, the uneven distribution of the transmission medium (such as air) in the housing may make the acoustic wave emitted from the speaker 126 asynchronously drive the two passive radiators 124 for vibration so that the amplitudes or the frequencies of the two passive radiators 124 may be inconsistent with each other and unable to counteract each other effectively. In addition, when the distance between the two passive radiators 124 is too far from each other, even though the amplitudes or the frequencies of the two passive radiators 124 are consistent with each other, the vibrations produced by the two passive radiators 124 may fail to effectively counteract each other due to a too long transmission path. In addition, when the distance between the two passive radiators 124 is too close to each other, the two mass blocks 124*a* during vibrating may contact each other to affect the normal operation. Accordingly, the gap G between the two passive radiators 124 in the embodiment ranges, for example, ⅕-⅐ of the outer diameter d of each the passive radiator 124, which can avoid the distance between the two passive radiators 124 from too far, make the acoustic wave emitted from the speaker 126 synchronously drive the two passive radiators 124 for vibration and further ensure the vibrations produced by the two passive radiators 124 counteracting each other and avoid the two mass blocks 124*a* during vibrating from contacting each other due to the too close distance of the two passive radiators 124. For example, the outer diameter d of each the passive radiator 124 is, for example, 2-3 inch and the gap G between the two passive radiators 124 ranges, for example, between 10 mm and 15 mm.

In the embodiment, the thin electronic device 100 as shown by FIG. 1 has a display surface 110*a* and the thickness of the housing 122 (referring to FIGS. 2 and 3) of each the speaker module 120 in a direction perpendicular to the display surface 110*a* is less than thicknesses of the housing 122 in other directions. In other words, the speaker module 120 has a smaller thickness in the direction perpendicular to the display surface 110*a*, which is in favour of the sliming design of the thin electronic device 100.

Figure 4:
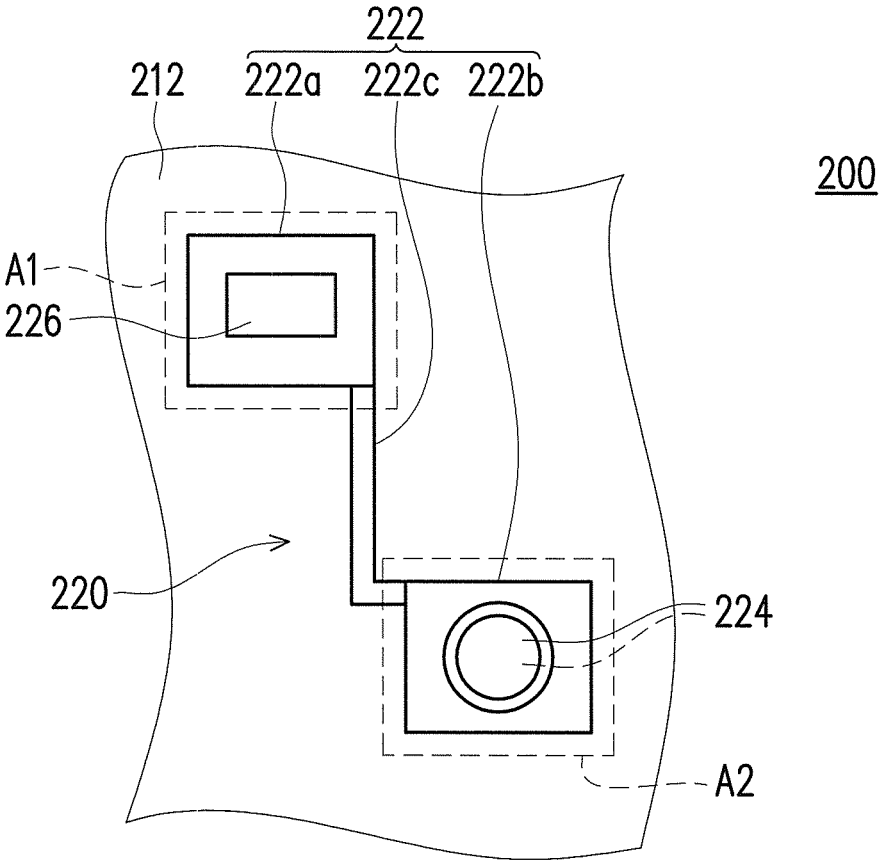
FIG. 4 is a schematic diagram of a thin electronic device and the speaker module thereof according to another embodiment of the invention.

FIG. 4 is a schematic diagram of a thin electronic device and the speaker module thereof according to another embodiment of the invention. Referring to FIG. 4, in a thin electronic device 200 of the embodiment, two passive radiators 224 are disposed in symmetrical manner so as to make the can make the two acoustic waves thereof counteract each other to achieve the effects of the two passive radiators 124 shown by FIGS. 2 and 3, which is omitted to describe. The unique of the thin electronic device 200 from the thin electronic device 100 rests in that the housing 222 of the speaker module 220 includes a first chamber 222*a*, a second chamber 222*b* and a tube 222*c*. The first chamber 222*a* is disposed at a first area A1 in the case 212 of the thin electronic device 200, the second chamber 222*b* is disposed at a second area A2 in the case 212 and the tube 222*c* is connected between the first chamber 222*a* and the second chamber 222*b*. The speaker 226 is disposed at the first chamber 222*a* and the two passive radiators 224 are disposed at the second chamber 222*b*.

Under the aforementioned layout, the acoustic wave emitted from the speaker 226, through the guiding of the tube 222*c*, reaches the second chamber 222*b* where the two passive radiators 224 are located at, so that the two passive radiators 224 can relatively synchronously receive the acoustic wave emitted from the speaker 226 to ensure the vibrations produced by the two passive radiators 224 counteracting each other. In addition, when the layout space in the thin electronic device 200 (in a portable electronic device such as a notebook or a tablet computer) is insufficient so that the speaker 226 and the passive radiators 224 are restricted to be respectively disposed at different areas (i.e., the aforementioned first area A1 and second area A2), the passive radiators 224 of the speaker module 220 in the embodiment is still able to be normally operated by means of the guiding of the tube 222*c* on the acoustic wave, which advances the flexibility and variety of disposing the speaker module 220.

In summary, the speaker module of the invention is able to enhance the subwoofer performance thereof by employing the two passive radiators, wherein the two passive radiators are respectively disposed in symmetrical manner at the two side walls of the housing and are overlapped with each other. Thus, when the acoustic wave emitted from the speaker drives the two passive radiators, the low-frequency vibrations produced by the two passive radiators can counteract each other. In this way, the speaker module can have good subwoofer performance and smaller vibration level so as to advance the sound output quality of the thin electronic device. In addition, the gap G between the two passive radiators ranges ⅕-⅐ of the outer diameter of each the passive radiator, which can avoid the distance between the two passive radiators from too far to ensure the acoustic wave emitted from the speaker synchronously drive the two passive radiators for vibration and further ensure the vibrations produced by the two passive radiators counteracting each other and can avoid the two mass blocks during vibrating from contacting each other due to the too close distance of the two passive radiators so as to ensure the normal operation thereof.

It will be apparent to those skilled in the art that the descriptions above are several preferred embodiments of the present invention only, which does not limit the implementing range of the present invention. Various modifications and variations can be made to the structure of the present invention without departing from the scope or spirit of the invention. In view of the foregoing, the protective scope of the present invention is given by the following claims and their equivalents.

What is claimed is:

1. A speaker module, comprising:

a housing, having two opposite side walls;

two passive radiators, respectively disposed at the two side walls, wherein the two passive radiators are overlapped with each other in a direction and have a gap therebetween; and a speaker, disposed at the housing, wherein an acoustic wave emitted from the speaker drives the two passive radiators to vibrate in the direction, wherein the housing comprises a first chamber, a second chamber and a tube, the tube is connected between the first chamber and the second chamber, the speaker is disposed at the first chamber, the two passive radiators are disposed at the second chamber, and the acoustic wave emitted from the speaker is configured to reach the second chamber via the tube.

2. The speaker module as claimed in claim 1, wherein the gap between the two passive radiators ranges ⅕-⅐ of outer diameter of each the passive radiator.

3. The speaker module as claimed in claim 1, wherein projections of the two passive radiators at each of the side walls coincide with each other.

4. The speaker module as claimed in claim 1, wherein each of the passive radiators comprises a mass block and an elastic element, the elastic element is connected between the mass block and the housing, and the mass block is configured to vibrate in the direction through elastic deformation of the elastic element.

5. The speaker module as claimed in claim 4, wherein mass of the two mass blocks are the same as each other.

6. The speaker module as claimed in claim 4, wherein elastic coefficients of the two elastic elements are the same as each other.

7. The speaker module as claimed in claim 1, wherein each of the passive radiators is connected to the corresponding side wall in fastening way.

8. A thin electronic device, comprising:

a body, having a case; and at least one speaker module, comprising:

a housing, disposed in the case and having two opposite side walls;

two passive radiators, respectively disposed at the two side walls, wherein the two passive radiators are overlapped with each other in a direction and have a gap therebetween; and a speaker, disposed at the housing, wherein an acoustic wave emitted from the speaker drives the two passive radiators to vibrate in the direction, wherein the speaker is protruded from the housing along an axis, and the axis does not pass through the gap between the passive radiators.

9. The thin electronic device as claimed in claim 8, wherein the quantity of the at least one speaker module is two, the case has a bottom side, and the two speaker modules are respectively disposed at opposite two ends of the bottom side.

10. The thin electronic device as claimed in claim 8, having a display surface, wherein thickness of the housing in a direction perpendicular to the display surface is less than thicknesses of the housing in other directions.

11. The thin electronic device as claimed in claim 8, wherein the gap between the two passive radiators ranges ⅕-⅐ of outer diameter of each the passive radiator.

12. The thin electronic device as claimed in claim 8, wherein projections of the two passive radiators at each of the side walls coincide with each other.

13. The thin electronic device as claimed in claim 8, wherein the housing comprises a first chamber, a second chamber and a tube, the first chamber is disposed at a first area in the case, the second chamber is disposed at a second area in the case, the tube is connected between the first chamber and the second chamber, the speaker is disposed at the first chamber, the two passive radiators are disposed at the second chamber, and the acoustic wave emitted from the speaker is configured to reach the second chamber via the tube.

* * * * *